US006666702B1

(12) United States Patent
Pickles

(10) Patent No.: US 6,666,702 B1
(45) Date of Patent: Dec. 23, 2003

(54) ELECTRICAL CONNECTOR WITH MATCHING DIFFERENTIAL IMPEDANCE

(75) Inventor: Charles S. Pickles, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/262,358

(22) Filed: Sep. 30, 2002

(51) Int. Cl.[7] ..... H01R 13/62

(52) U.S. Cl. ..... 439/328; 439/326; 439/327; 439/341

(58) Field of Search ..... 439/328, 326, 439/327, 341

(56) References Cited

U.S. PATENT DOCUMENTS 5,713,764 A 2/1998 Brunker et al.
6,361,344 B1 * 3/2002 Yu ..... 439/328
6,540,550 B2 * 4/2003 Chang et al. ..... 439/541.5
6,551,120 B2 * 4/2003 Daskalakis et al. ..... 439/328

* cited by examiner

*Primary Examiner*—Dean A. Reichard
*Assistant Examiner*—Jinhee J Lee
(74) *Attorney, Agent, or Firm*—Wei Te Chung

(57) ABSTRACT

An electrical connector (1) comprises an insulative housing (2) and a plurality of upper and lower terminals (3,4) received in the insulative housing. The insulative housing includes a plurality of retention walls (205). Every two adjacent retention walls define a narrow upper passageway (206) and a wide lower passageway for receiving a corresponding upper terminal. Each of the terminals comprises a mounting plate (30, 40, 50, 60), a resilient arm (32, 42, 52, 62) with a contacting portion **(320, 420, 31, 41*a*)** at a free end thereof. The upper and lower passageways are wider than the terminals so that different media may be inserted into the insulative housing for tuning differential impedance of the connector.

4 Claims, 11 Drawing Sheets

ELECTRICAL CONNECTOR WITH MATCHING DIFFERENTIAL IMPEDANCE

BACKGROUND OF THE INVENTION

1. Field of the Invention

The present invention relates to an electrical connector, and particularly to an electrical connector with matching differential impedance in according to high transmitting frequency and speed of signal.

2. Description of Prior Art

During the past decade, PCI standard has been a very successful, general purpose I/O interconnect standard instead of ISA standard. However, demands of emerging and future computing models will exceed the bandwidth and scalability limits that are inherent in multi-drop, parallel bus implementations. Technologies such as Central Process Unit (CPU) speeds that will exceed 10 GHz, faster memory speeds, higher-speed graphics, 1 Gigabit and 10 Gigabit Local Area Network (LAN), IEEE1394b, InfiniBand, fabrics and others will drive the need for much greater internal bandwidth. Thus, an improved industrial interconnect standard, such as 3GIO standard which is established by Intel, is required. The 3GIO architecture will be a high performance, highly flexible, scalable, reliable, stable and cost effective general purpose I/O architecture that is the natural evolution of PCI. The signaling, protocol and mechanical features of 3GIO standard is disclosed on an article entitled "Creating a Third Generation I/O Interconnect", which is published on the web:

http://www.intel.com/technology/3gio/downloads/3rdGenWhitepaper.htm.

As the 3GIO standard can stand higher frequency and faster speed than the PCI and ISA, a connector conforming the 3GIO standard requires matching differential impedance as well as the insertion/return losses and the cross-talk.

In addition, impedance matching of terminals has already been discussed in U.S. Pat. Nos. 5,066,136, 5,496,183, 4,664,968 and 6,347,962. In these patents, each right angle connectors comprises a terminal module and a shielding member. The shielding member is redesigned to match the impedance of contacts of the terminal module.

An alternative electrical connector has been proposed in U.S. Pat. No. 5,713,764. A card edge connector comprises an insulative housing and a plurality of terminals received in the insulative housing. The terminals comprises body portions located in the insulative housing and contact portions for mating with corresponding terminals of a mating connector. The area of the body portion is selectively varied to vary the capacitance of the terminal, therefore, the impedance of the connector may match a given impedance of a mating electrical circuit.

However, the designs cannot be applied on an electrical connector conforming to the 3GIO standard with matching differential impedance for high frequency and fast speed. Hence, an improved electrical connector of the 3GIO standard is required to overcome the disadvantages of the conventional connector.

SUMMARY OF THE INVENTION

Accordingly, an object of the present invention is to provide an electrical connector with matching differential impedance for high frequency and speed.

In order to achieve the object set forth, an electrical connector comprises an insulative housing and a first and second terminals received in the insulative housing. The insulative housing comprises an upper wall and a lower wall defining a receiving cavity therebetween for receiving an inserted daughter card. The insulative housing defines a receiving passageway in communicating with the receiving cavity. The receiving passageway includes a first passageway section and a second passageway section. The width of the first passageway section is different from that of the second passageway section. Each of the terminals comprises a contacting portion projecting into the receiving cavity for contacting with the daughter card. The first terminal includes a resilient arm received in the receiving passageway. The width of the first terminal is smaller than that of either of the first passageway sections whereby a room in the receiving passageways is left by the terminals for tuning differential impedance.

The invention also contemplates an electrical connector comprising an insulative housing and a plurality of terminals received in the insulative housing. The insulative housing comprises an upper wall and a lower wall with a receiving cavity therebetween. The upper wall forms a plurality of rear projections at a rear end thereof and the lower wall forms a plurality of front projections at a front end thereof. Every two adjacent projections define a receiving recess. Each of the terminal comprises a mounting plate received in a corresponding receiving recess. The mounting plate forms a plurality of retention dimples for engaging with corresponding projections to securely retain the terminal in a true position.

Other objects, advantages and novel features of the invention will become more apparent from the following detailed description when taken in conjunction with the accompanying drawings.

DETAILED DESCRIPTION OF PREFERRED EMBODIMENTS

Figure 1:
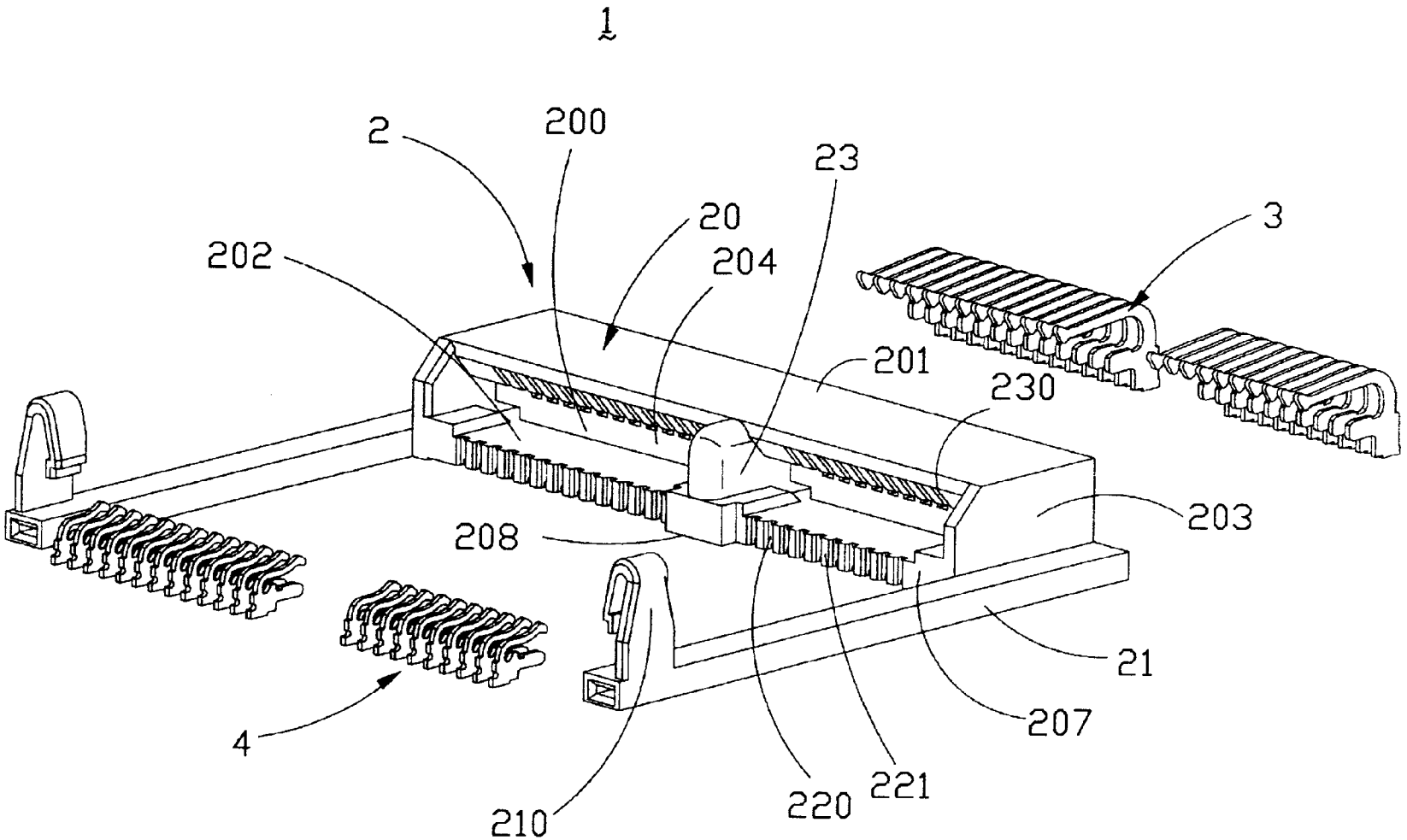
FIG. 1 is an exploded, perspective and front view of an electrical connector of a first embodiment in accordance to the present invention.

Reference will now be made to the drawing figures to describe the present invention in detail.

Referring to FIG. 1, an electrical connector 1 conforming to the 3GIO standard in accordance to a first embodiment of the present invention is shown. The electrical connector 1 comprises an insulative housing 2 and a plurality of upper terminals 3 and lower terminals 4 received in the insulative housing 2.

Figure 2:
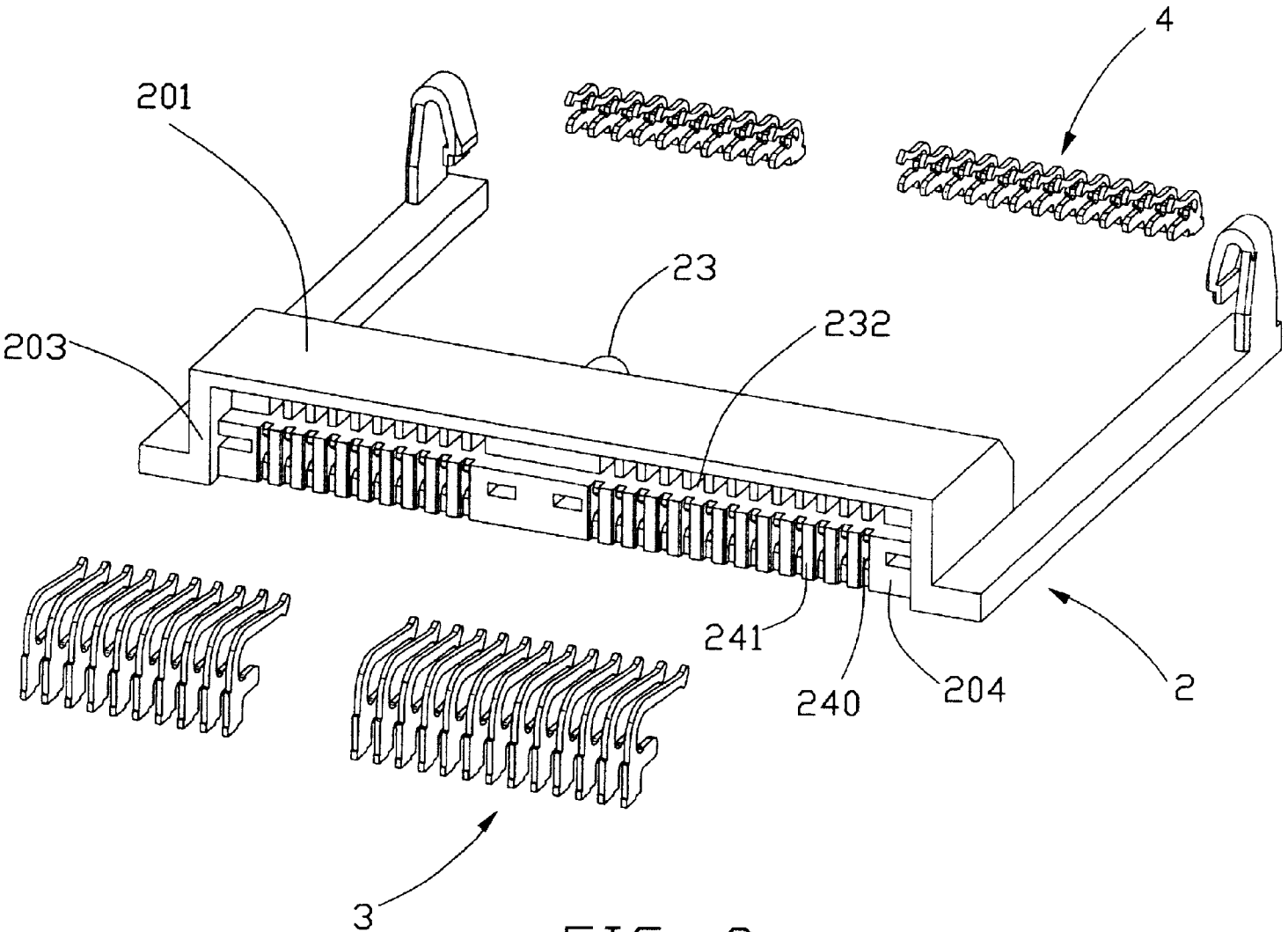
FIG. 2 is an exploded, perspective and rear view of the electrical connector of FIG. 1.

Further referring to FIGS. 1 and 2, the insulative housing 2 comprises a main body 20 and a pair of arms 21 extending forwardly from lateral edges of the main body 20. The arms 21 each form a latch 210 extending upwardly from a free end thereof for securely retaining an inserted daughter card (not shown) on the insulative housing 2. The main body 20 defines a mounting surface 208 on a bottom thereof for engaging with a mother board (not shown) and a mating surface 207 perpendicular to the mounting surface 208 for engaging with the inserted daughter card. In addition, the main body 20 comprises an upper wall 201, a lower wall 202, a pair of sidewalls 203 interconnecting the upper wall 201 and the lower wall 202, and a rear wall 204 interconnecting the sidewalls 203, the upper wall 201 and the lower wall 202 at a rear end thereof. The upper wall 201, lower wall 202, rear wall 204 and sidewalls 203 together define a receiving cavity 200 for receiving the daughter card. A key protrusion 23 extends forwardly from a substantially middle portion of the rear wall 204 beyond the mating surface 207 for securing a true insertion of the daughter board. The key protrusion 23 interconnects with the upper wall 201 and the lower wall 202 respectively at an upper and lower end thereof.

Figure 8:
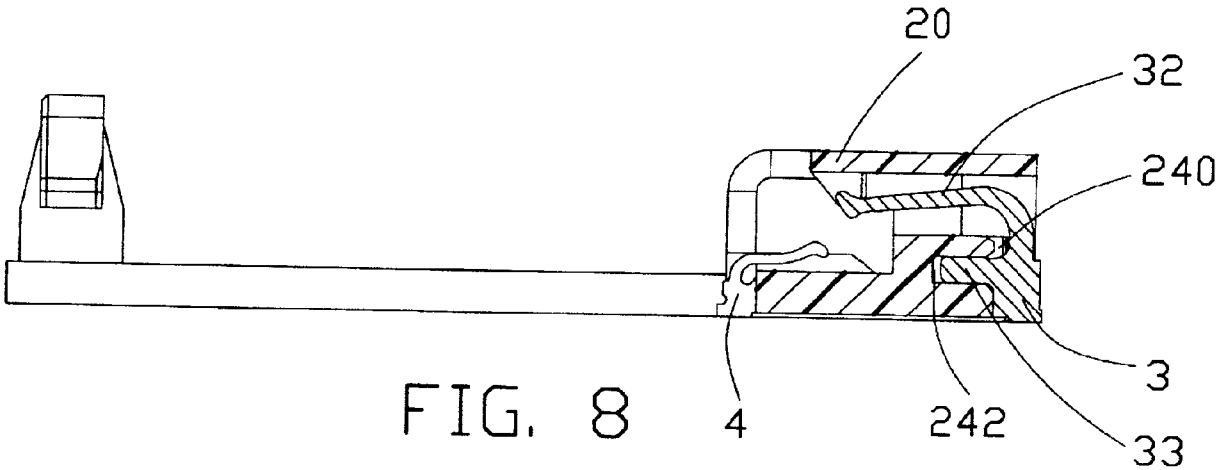
FIG. 8 is a cross-sectional view of the electrical connector showing an upper terminal received in an insulative housing.
Figure 9:
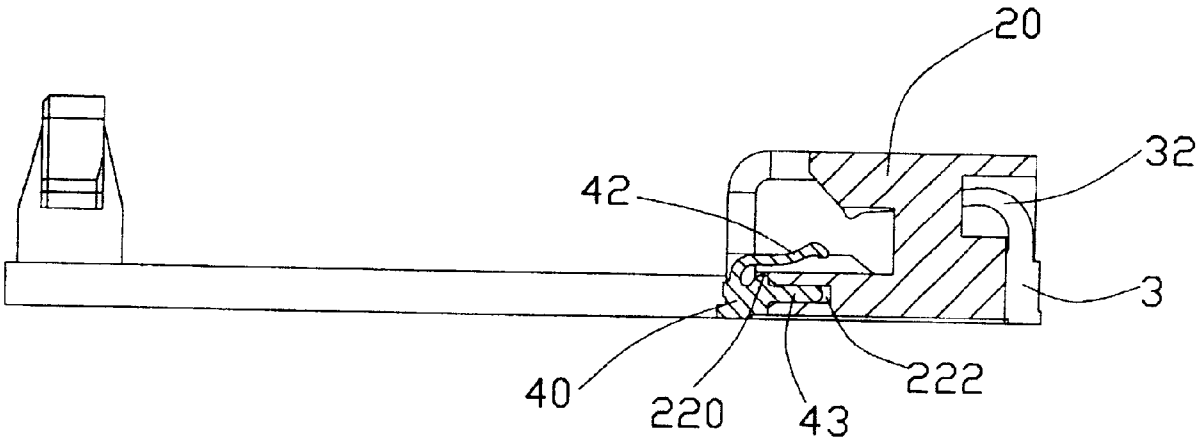
FIG. 9 is a cross-sectional view of the electrical connector showing a lower terminal receiving in the insulative housing.
Figure 10:
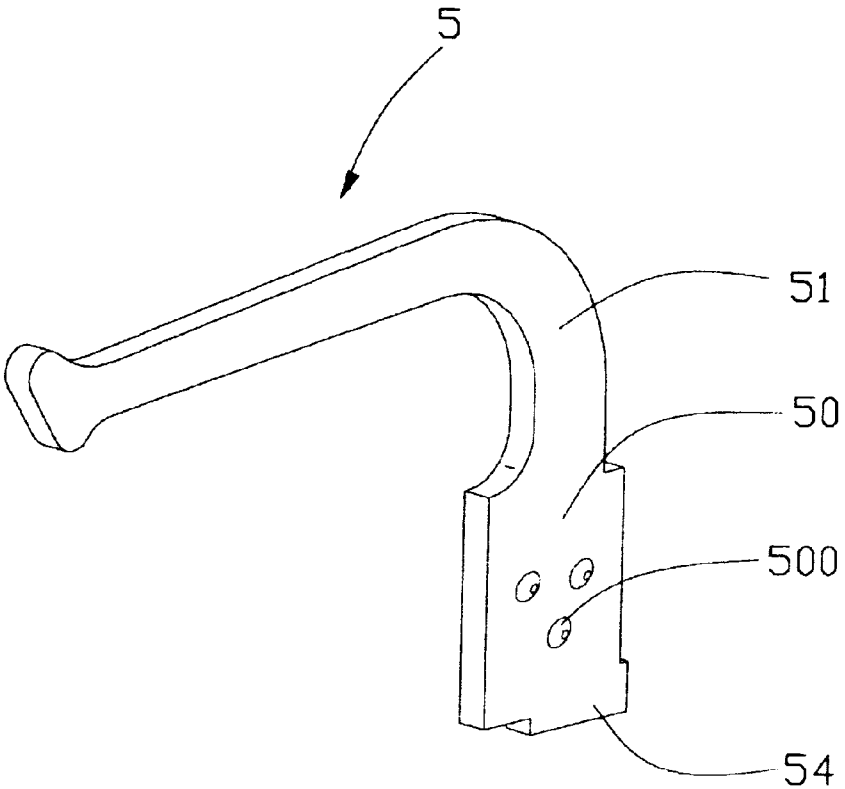
FIG. 10 is a perspective view of a pair of terminals in accordance to a second embodiment of the present invention.
Figure 10:
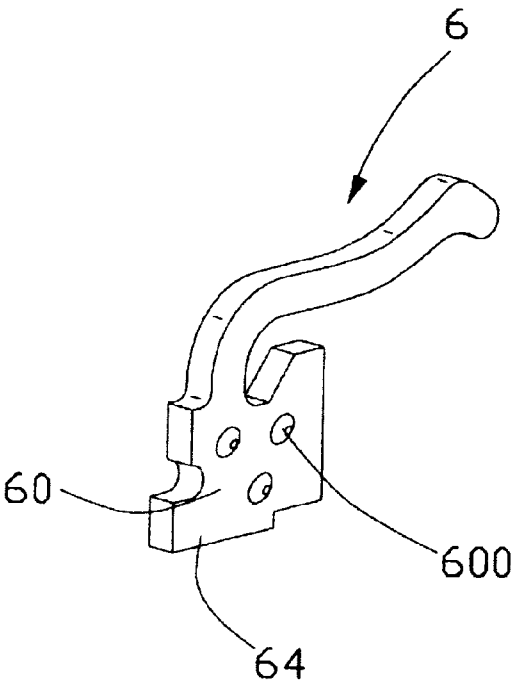
Figure 11:
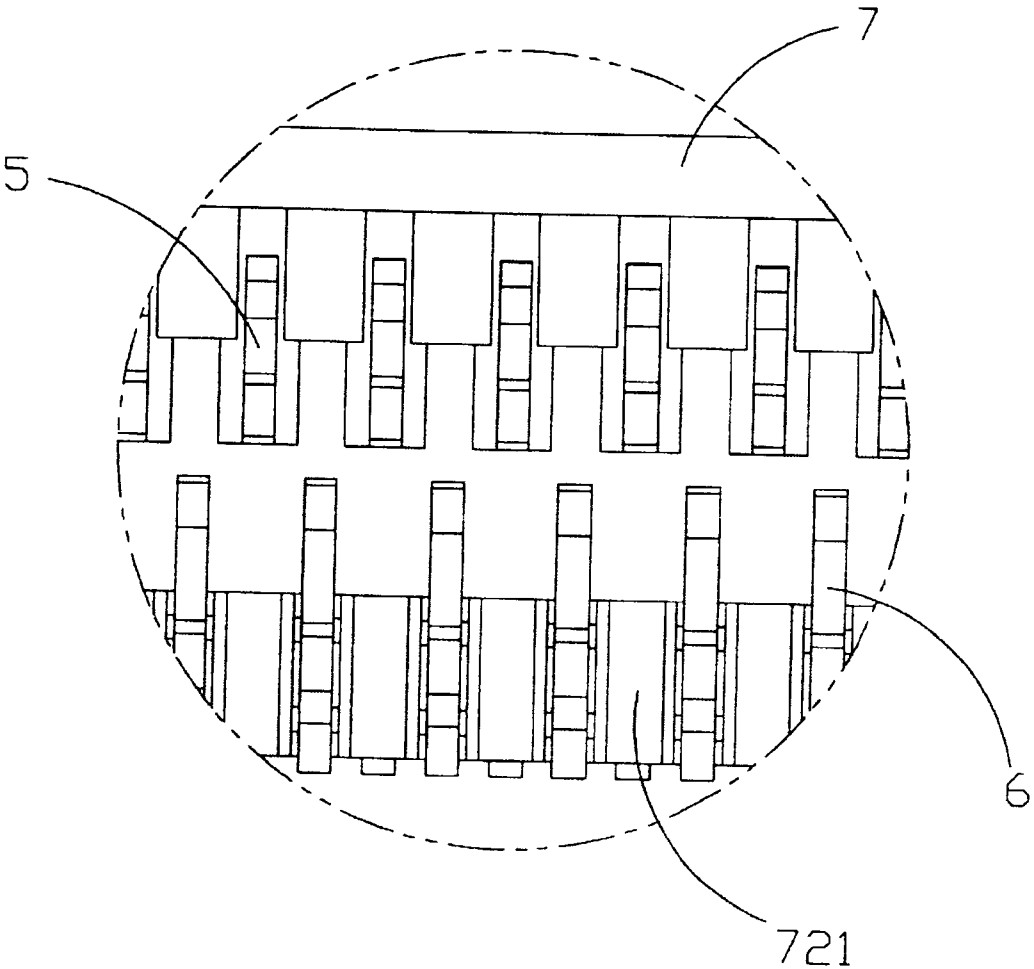
FIG. 11 is an enlarged view similar to FIG. 7 in accordance to the second embodiment.
Figure 12:
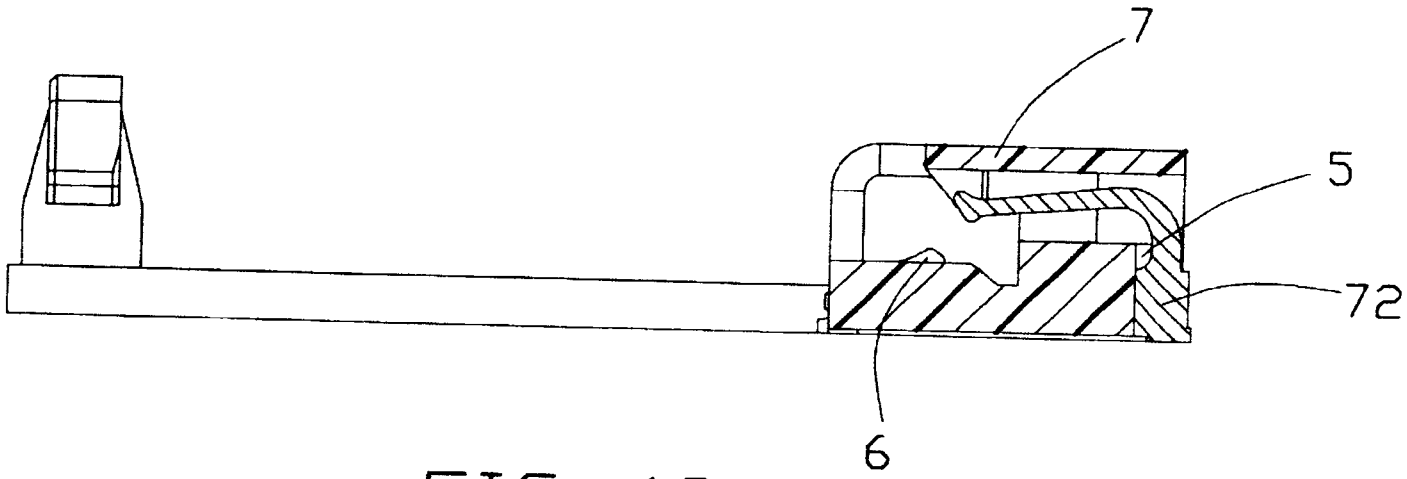
FIG. 12 is a cross-sectional view similar to FIG. 8 in accordance to the second embodiment.
Figure 13:
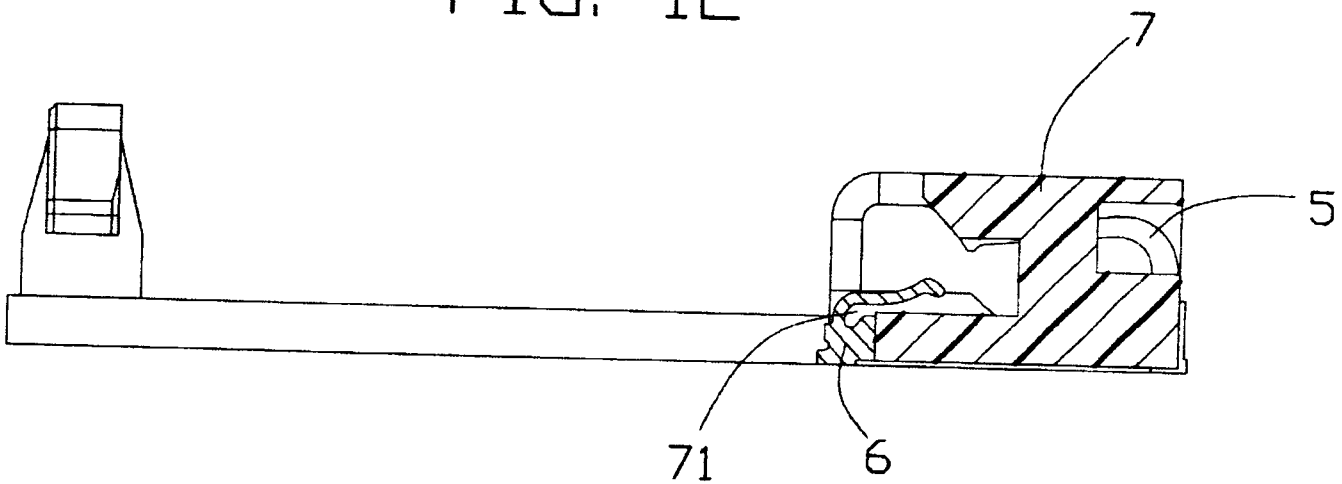
FIG. 13 is a cross-sectional view similar to FIG. 9 in accordance to the second embodiment.

In conjunction with FIGS. 8 and 9, the insulative housing 2 forms a plurality of retention walls 22 on an inner face of the upper wall 201 and through the rear wall 204. Every two adjacent retention walls 22 define a receiving passageway in communicating with the receiving cavity 200. The receiving passageway includes an upper passageway section 230 and a lower passageway section 230. It should be noted that the width of the lower passageway section 230 is larger than that of the upper passageway section 230 and the width of the upper passageway section 230 is a slightly larger than that of the upper terminal 3. The rear wall 204 forms a plurality of rear projections 241 at a rear end thereof below the retention walls 241. Every two adjacent rear projections 241 define a rear retaining recess 240 therebetween. The lower wall 22 forms a plurality of front projections 221 at a front end thereof. Every two adjacent front projections 221 defines a front retaining recess 220 therebetween. In addition, the lower wall 202 defines a plurality of front retaining holes 222 in communicating with corresponding front retaining recesses 220 at a front end thereof and a plurality of rear retaining holes 242 in communicating with corresponding rear retaining recesses 240 at a rear end thereof. It should be noted that the front and rear retaining holes 222, 242 extend along a front to rear direction.

Figure 3:
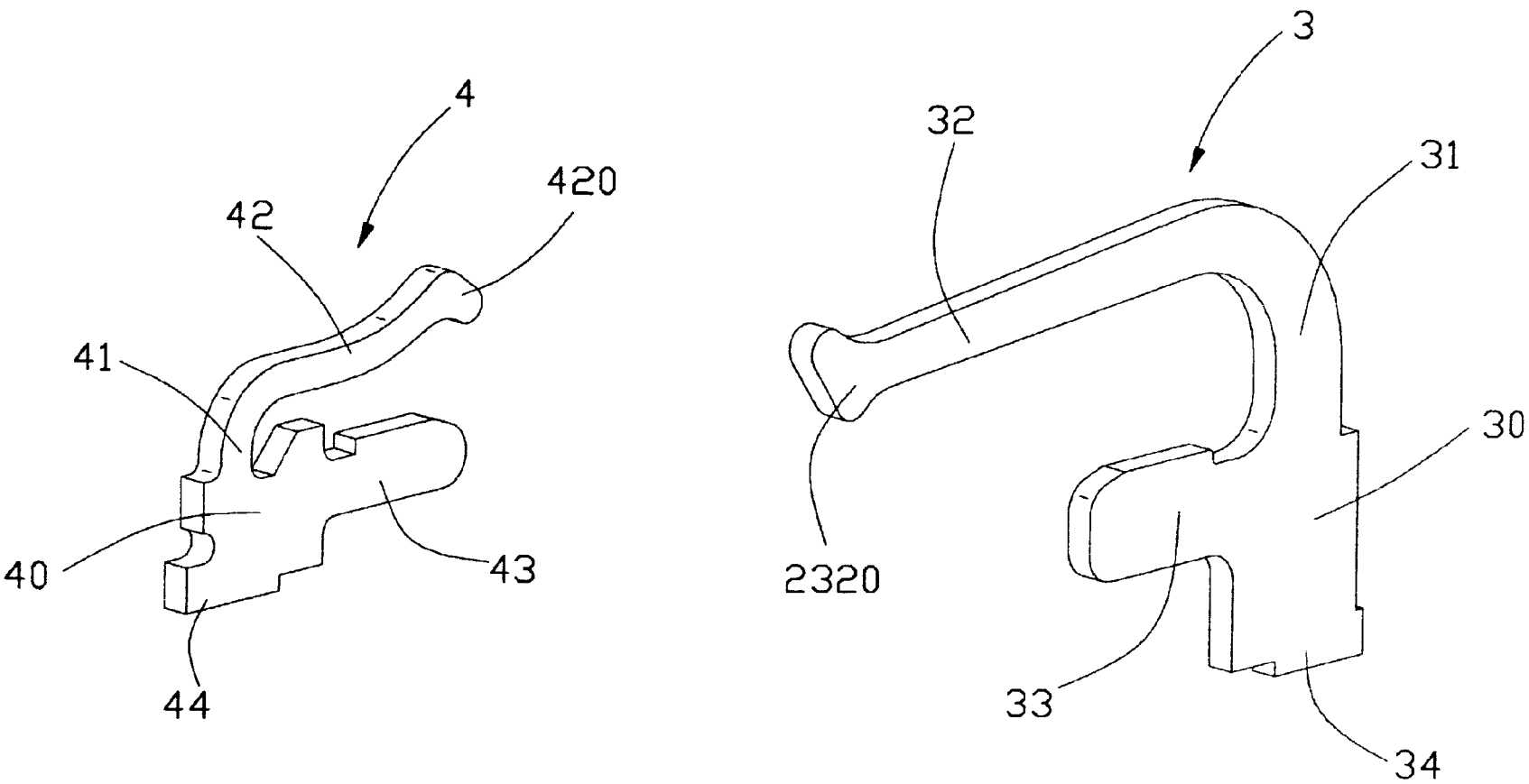
FIG. 3 is a perspective view of a pair of terminals in FIG. 1.

Referring to FIG. 3, each of the upper terminals 3 comprises a first mounting plate 30, a first connecting portion 31 extending upwardly from a top end of the first mounting plate 30, a substantially horizontal first resilient arm 32 extending forwardly from a top end of the first connecting portion 31, a horizontal first retention arm 33 extending forwardly from a top end of the first mounting plate 30 and a horizontal first solder tail 34 at a bottom end of the first mounting portion 30. A curved first contacting portion 320 projects downwardly at a free end of the first resilient arm 32. Similarly, each of the lower terminals 4 comprises a second mounting plate 40, a second connecting portion 41 extending upwardly from a top end of the second mounting plate 40, a substantially horizontal second resilient arm 42 extending rearwardly from a top end of the second connecting portion 41, a horizontal second retention arm 43 extending forwardly from a top end of the second mounting plate 40 and a horizontal second solder tail 44 at a bottom end of the second mounting portion 40. A curved second contacting portion 420 projects upwardly at a free end of the second resilient arm 42.

Figure 4:
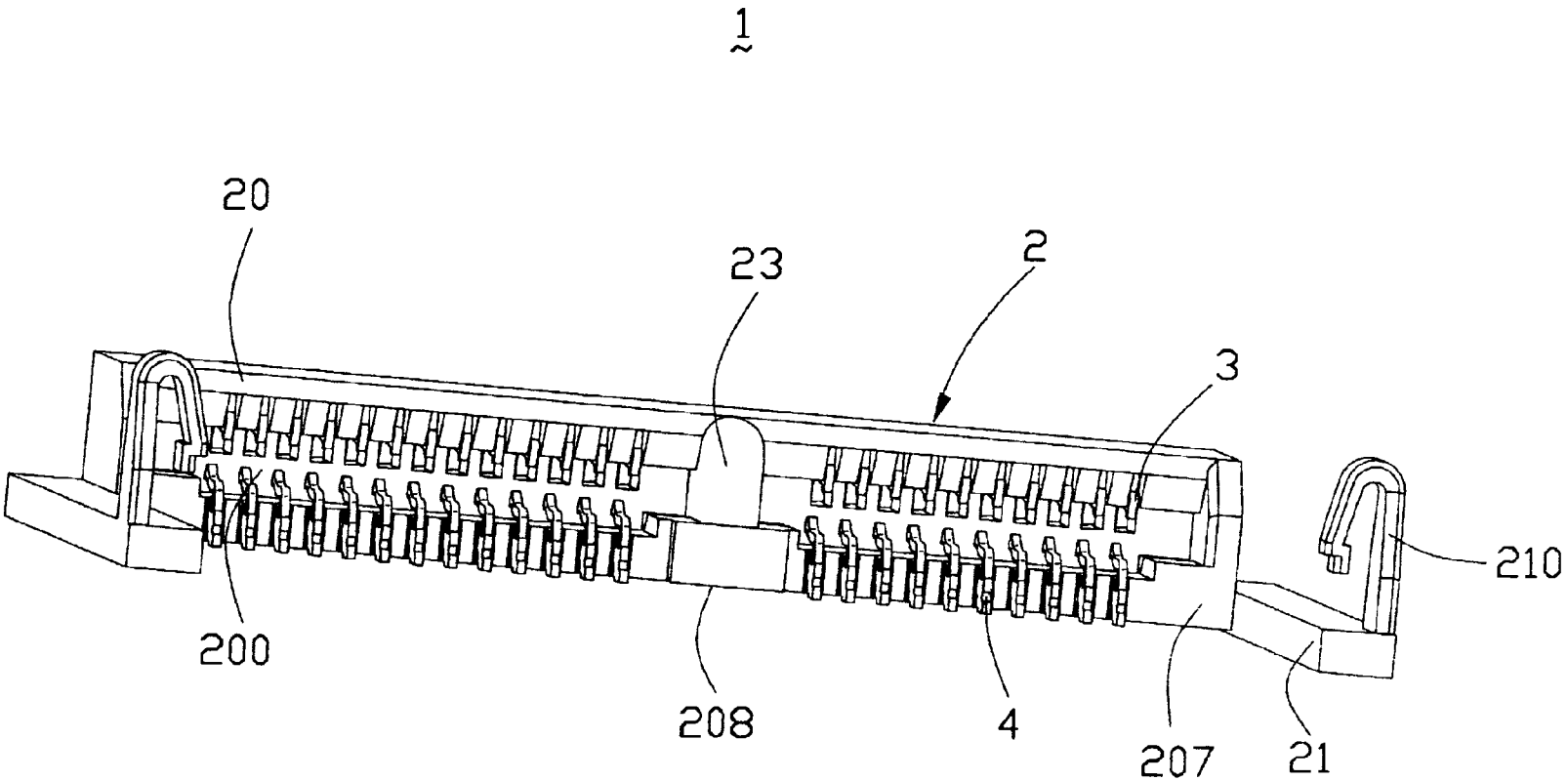
FIG. 4 is an assembled, front view of the electrical connector in FIG. 1.
Figure 5:
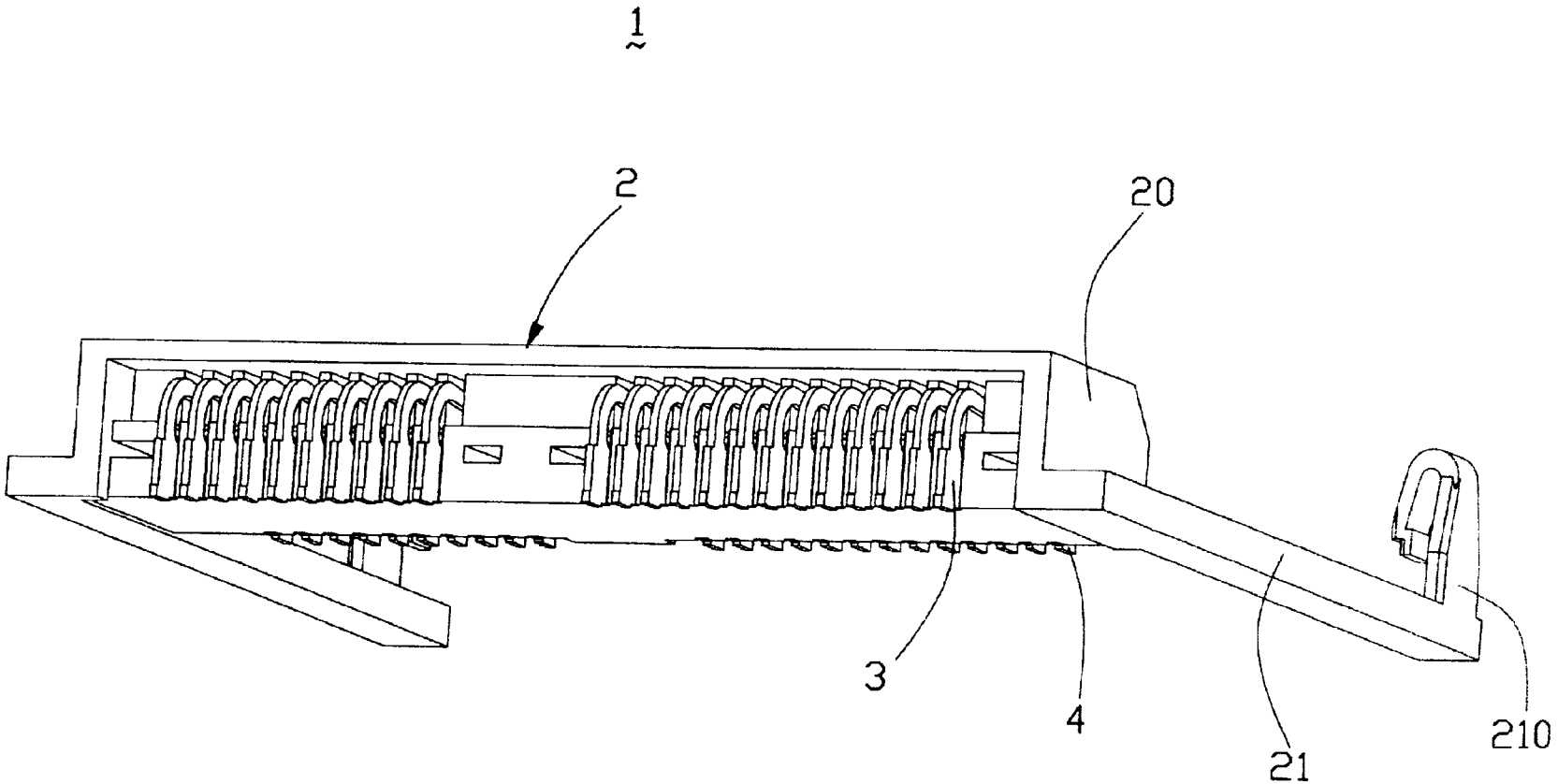
FIG. 5 is an assembled, rear view of the electrical connector in FIG. 2.

Referring to FIGS. 4–5 in conjunction with FIGS. 8–9, in assembly, the lower terminals 4 are assembled to the main body 20 of the insulative housing 2 with the second retention arms 43 received in corresponding front retaining holes 222. The second resilient arms 42 project into the receiving cavity 200 and a portion of each second retention plate 40 is received in a corresponding front retaining recess 220. The upper terminals 3 are assembled to the main body 20 of the insulative housing 2 with the first resilient arms 32 received in corresponding upper and second passageway sections 230, 232 and the first retention arms 33 received corresponding rear retaining holes 242. The first contacting portions 320 project into the receiving cavity 200 and a portion of each first retention plate 30 is received in a corresponding rear retaining recess 240. Successively, the electrical connector I is assembled to a mother board (not shown) with the first and second solder tails 34, 44 soldering on corresponding solder pads of the mother board. While the daughter card is inserted into the receiving cavity 200 of the main body 20, the latches 210 engages with lateral edges of the daughter card for securely retaining the daughter card in a true position. Meanwhile, the first contacting portions 320 of the upper terminals 3 are contacting with corresponding contacting pads on an upper surface of the daughter card. The second contacting portions 420 of the lower terminals 4 are contacting with corresponding contacting pads on a lower surface of the daughter card.

Figure 6:
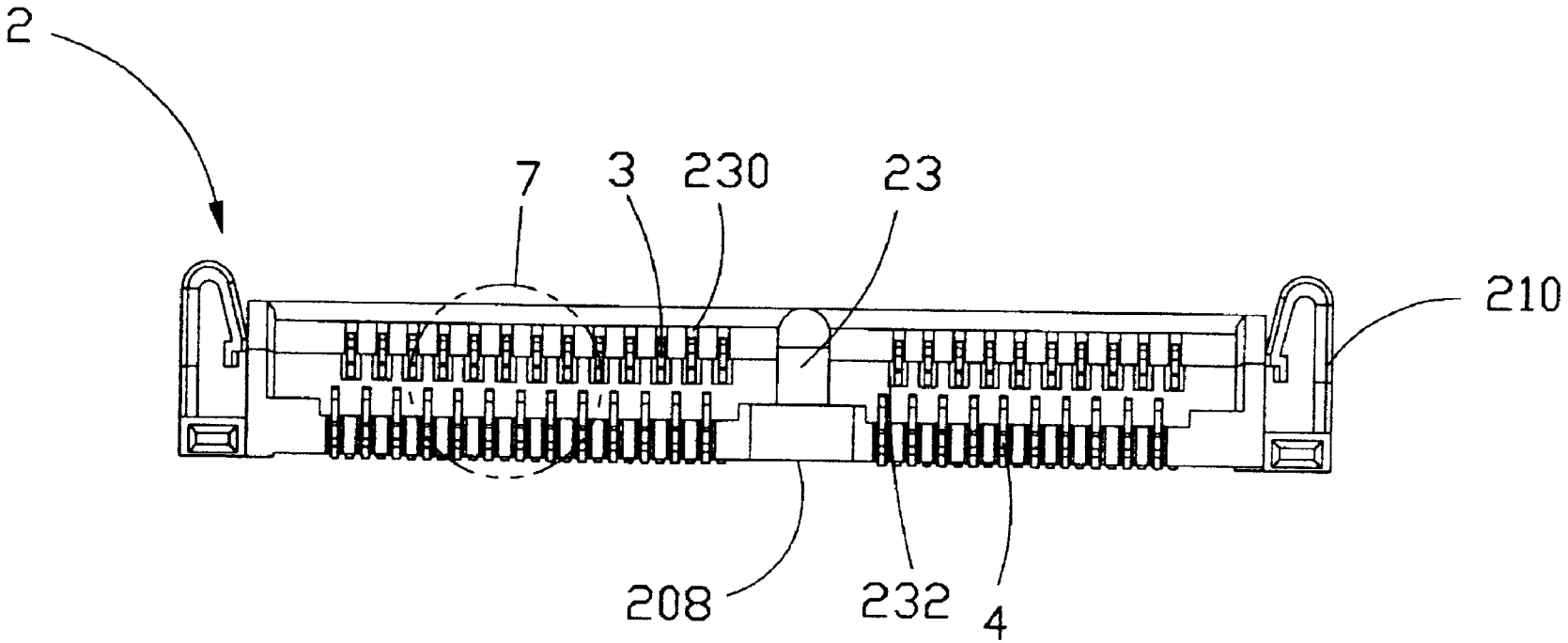
FIG. 6 is a front planar view of the electrical connector in FIG. 4.
Figure 7:
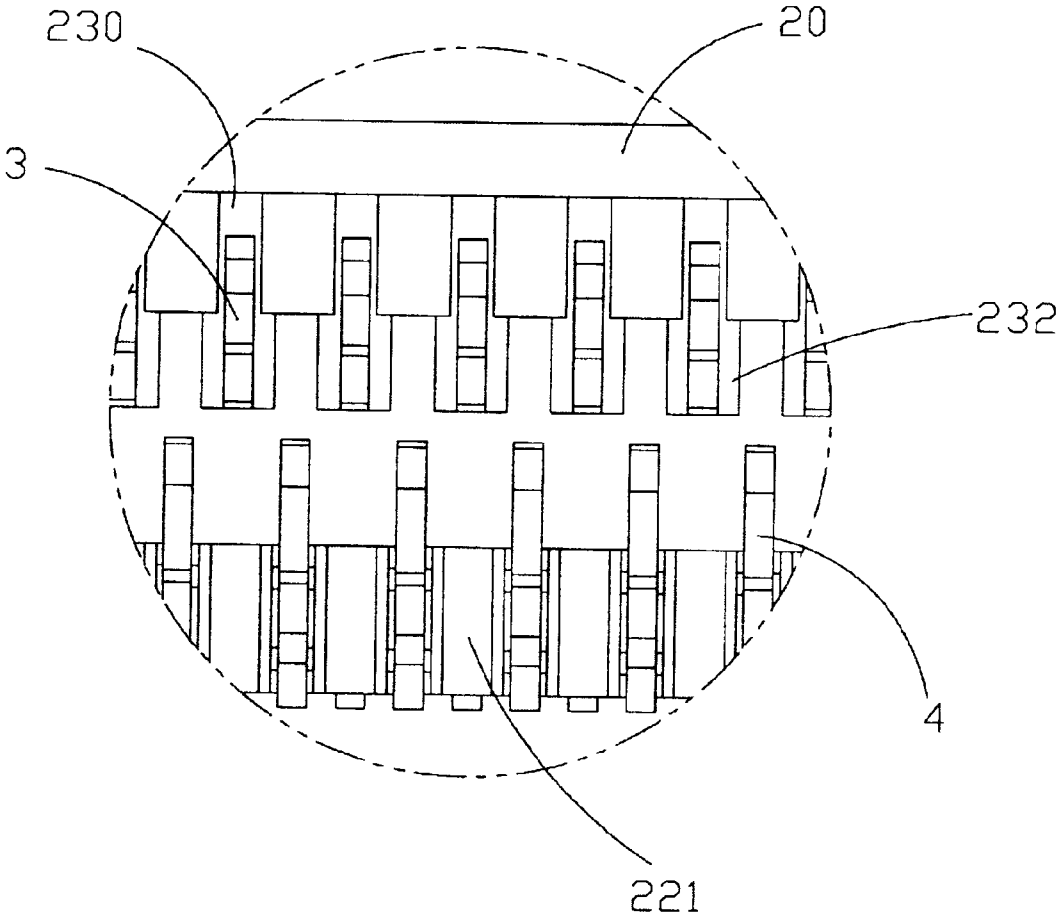
FIG. 7 is an enlarged view of a circled portion 7 of FIG. 6.

Referring to FIGS. 6 and 7, the first resilient arms 32 are received in corresponding upper and second passageway sections 230, 232. Because the width of the upper passageway section 230 is slightly larger than that of the first resilient arm 32 of the upper terminals 3 and the width of the lower passageway section 230 is larger than that of the first passageway section 230, room between the first resilient arm 32 and a corresponding retention wall 22 may be fulfilled with different media, such as air or plastic etc., for tuning capacitance between two adjacent upper terminals 3. Therefore differential impedance between two adjacent upper terminals 3 is matched in accordance to different transmitting frequency and speed of signal.

FIGS. 10–14 show a design of second embodiment in accordance to the present invention. In this embodiment, each of upper (lower) terminals 5 (6) comprises a mounting plate 50 (60), a contacting portion 51 (61) and a solder tail 54 (64). An insulative housing 7 comprises a plurality of front and rear projections 721 (741). Every two projections 721 (741) define a receiving recess for receiving the mounting plate 50 (60). The mounting section 50 (60) forms a plurality of transverse retention dimples 500 (600) for engaging with corresponding projections 721 (741) to securely retain the terminal 5 (6) in a true position. There is no retention arm in this embodiment; such will avoid producing inductance between the contacting portion and the retention arm. Therefore, the terminal has a controlled differential impedance in spite of increasing frequency and transmitting speed of the signal. The others are the same as the first embodiment well described in the above; thus, a detailed description thereof is omitted here.

It is apparent that the two embodiments may be combined together. For example, in the first embodiment, the terminals may have retention dimples instead of the retention arm. Therefore, the capacitance and inductance of the terminals may be tuned, thereby varying the differential impedance according to different frequency and transmitting speed of signal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for contacting with a daughter card, comprising:

an insulative housing comprising an upper wall and a lower wall defining a receiving cavity therebetween for receiving the daughter card, the insulative housing defining a receiving passageway in communicating with the receiving cavity, the receiving passageway including a first passageway section and a second passageway section, the width of the first passageway section being larger than that of the second passageway section; and a first and second terminals being attached to the insulative housing and each comprising a contacting portion projecting into the receiving cavity for contacting with the daughter card; wherein the first terminal includes a resilient arm received in the receiving passageway, and the width of the resilient arm of the first terminal is smaller than that of the first passageway section whereby a room in the receiving passageways is left by the terminals for adjusting impedance of the connector.

2. The electrical connector as described in claim 1, wherein each terminal comprises a mounting plate, a resilient arm extending from the mounting plate and a retention arm extending from the mounting plate for engaging with the insulative housing to securely retain the terminal in the insulative housing.

3. The electrical connector as described in claim 2, wherein the insulative housing defines a plurality of retaining holes for receiving corresponding retention arms.

4. The electrical connector as described in claim 1, wherein each terminal comprises a mounting plate and the mounting plate forms a plurality of dimples for engaging the insulative for securely retaining the terminal in a true position.

* * * * *